United States Patent [19]

Angele et al.

[11] 4,067,271

[45] Jan. 10, 1978

[54] WORKPIECE GUIDING DEVICE FOR SEWING MACHINES

[75] Inventors: Eugen Angele, Kaiserslautern; Erich Willenbacher, Karlsruhe, both of Germany

[73] Assignee: Pfaff Industriemaschinen GmbH, Germany

[21] Appl. No.: 696,397

[22] Filed: June 15, 1976

[30] Foreign Application Priority Data

July 24, 1975 Germany ..... 7523600

[51] Int. Cl.[2] ..... D05B 35/10

[52] U.S. Cl. ..... 112/153

[58] Field of Search ..... 112/152, 153, 136, 150, 112/148, 203, 121.15, 121.11

[56] References Cited

U.S. PATENT DOCUMENTS

| | | | |
|---|---|---|---|
| 117,716 | 8/1871 | Alter | 112/153 |
| 2,329,991 | 9/1943 | Kellum | 112/136 |
| 2,546,135 | 3/1951 | Reid | 112/136 |
| 3,815,530 | 6/1974 | Denton | 112/153 X |
| 3,954,071 | 5/1976 | Mall et al. | 112/153 X |

*Primary Examiner*—H. Hampton Hunter
*Attorney, Agent, or Firm*—McGlew and Tuttle

[57] ABSTRACT

A guiding device for sewing machines which have means for feeding cloth of workpieces into association with a moving needle in a stitch forming area for effecting edge parallel seams, comprises a support table with a bottom plate supported on the table and having at least a portion spaced above the table and defining a cloth layer feed space and with a top plate overlying at least a portion of the bottom plate and spaced above it and defining a workpiece layer passageway therebetween. The top plate has a pressure point which may be urged toward a complementary point on the bottom plate at a location spaced from the stitch forming area. A plurality of pins supported on the bottom plate and extending upwardly through the top plate are arranged to extend laterally and in an acute angle to a line extending in the workpiece feed direction. A spring is arranged to bear downwardly on the top plate and adjustment means for varying the spacing between the top and bottom plate and the clamping effect of the top plate over the bottom plate is supported on the bottom plate and has means bearing on the spring which may be shifted in order to vary the effect of biasing force thereof and the spacing between the top and bottom plate.

13 Claims, 5 Drawing Figures

WORKPIECE GUIDING DEVICE FOR SEWING MACHINES

BACKGROUND OF THE INVENTION

1. Field of the Invention

This invention relates, in general, to a construction of sewing machines and, in particular, to a new and useful guiding device for sewing machines having means for feeding cloth workpieces into association with a moving needle to effect edged parallel seams and with two plates forming a passageway and a pressure point for a cloth layer arranged laterally of the stitch forming area and wherein the top plate can be moved vertically relative to the bottom plate and which includes a ruler arranged laterally at an acute angle to a line extending through the feed direction of the workpiece through the needle axis.

2. Description of the Prior Art

A known sewing machine workpiece guiding device has three plates for the separate contour control of two workpiece layers, which come in contact with each other under initial stress at a point laterally in front of the stitch forming area to form a pressure point for each workpiece layer. In this way a braking action is exerted on each individual workpiece layer during the feed in the range of the pressure points, so that each workpiece layer performs a rotary movement independent of the other workpiece layer, and thus bears on a ruler which extends in an acute angle to a line extending in feed direction through the needle axis. Between the plates are arranged spacers at the ends opposite the pressure points in the proximity of the ruler. The spacers are replaceable to adapt the vertical plate distances to different cloth thicknesses. But this method is cumbersome and time-consuming if the cloth thicknesses change frequently. Besides it requires the keeping of a stock of a great number of spacers of different thickness.

In another known guiding device the central and top plate are arranged on the bottom plate by means of a hinge with a horizontal axis of rotation. The ruler for the edge of the workpiece layers to be aligned is formed by several stop pins secured in the bottom plate and protruding through corresponding openings in the other two plates. The pressure of the plates in the range of the pressure points is produced by the weight of the plates. In order to be able to adapt the pressure to different cloth thicknesses, each plate is adjustable by means of its adjusting mechanism in its vertical position relative to the respective bottom plate. The distance between the ruler and the hinge is selected relatively great, so that the central and top plate are not overly inclined when sewing workpieces with a great cloth thickness, but still the disadvantage of this device is substantially the same as in the abovementioned device. If the plates are arranged at a small distance one above the other for the proper guidance of thin workpiece layers, a friction which hinders the alignment, is exerted on the workpiece layers in the case of thick layers, due to the resulting inclined position of the plate by the parts of the plates close to the stop pins. It was also found that a satisfactory alignment can only be achieved in workpieces with a great cloth thickness if a much greater pressure is exerted at the pressure points than in workpieces with medium or smaller cloth thickness. This requirement can only be met very unsatisfactorily in a device where the pressure is produced by the weight of the plates.

SUMMARY OF THE INVENTION

The invention produces means to align a single workpiece layer, which can be of any cloth thickness, during the sewing for the formation of edge-parallel seams continuously along the contours. Accordingly, the invention provides a guiding device where the vertical distance between two plates is adjustable while maintaining their substantially parallel alignment, and a low pressure is exerted with a small vertical plate distance and a high pressure is exerted with a great plate distance at the pressure point of the device in strict dependence on this adjustment.

The solution of this problem is characterized by the arrangement of an adjusting element bearing on the bottom plate and of a spring mechanism which bears on the top plate and includes adjustment means for varying the effective spring force and spring spacing.

The adjusting element, which can be arranged directly or indirectly between the two plates and whose thickness, which can be varied by changing its position, for example, by pushing, turning etc. determines the vertical distance between the two plates, thus performing the function of an adjustable spacer. When the workpiece is inserted into the device, the top plate bears on the workpiece, in the range of the pressure point and also on the adjusting element set to the thickness of the workpiece, so that it assumes substantially a position parallel to the bottom plate, in which its part close to the ruler does not have any frictional contact with the workpiece tending to impair the aligning action of the device. The pressure at the pressure point is produced by the spring mechanism, the size of the pressure being determined by the position of the clamping element. Since the clamping element is coupled directly or indirectly with the adjusting element, a certain pressure is associated with each position of the adjusting element and thus with each vertical position of the top plate adapted to the cloth thickness of the respective workpiece. In this way, the prerequisites for a satisfactory alignment, — a low pressure at the pressure point for thin workpiece layers and a high pressure for thick workpiece layers — can be met with particular advantage, since the required pressure is adjusted automatically and positively simultaneously with the adjustment of the vertical position of the top plate and the resulting adaptation to the workpiece thickness. The vertical position of the top plate can be adjusted indefinitely or in steps, depending on how the adjusting element is locked.

In accordance with one embodiment of the invention, three eccentrics are secured on a shaft provided with a handle, which is mounted in a stirrup secured at the end of the top plate opposite the pressure point. The outer ones of the eccentrics bear on the bottom plate, and a leaf spring is arranged under the central eccentric. One end of the leaf spring bears on the top plate and the other end is connected with an adjusting screw. The two outer eccentrics form an adjusting element, which is in this case not arranged directly, but indirectly between the two plates because of the stirrup in which the shaft carrying the eccentric is mounted. The clamping element is formed by the central eccentric, whose coupling with the other two eccentrics ensures that it is secured together with the other two eccentrics on a shaft, all eccentrics being arranged preferably in the same phase position. The adjusting screw permits an additional variation of the pressure, independent of the setting of the adjusting element, so that it can be adapted to other requirements caused, for example, by the surface quality of the workpiece.

Another embodiment of the invention includes a slide arranged on the guide secured at the end of the bottom plate opposite the pressure point, on which is molded at least one wedge surface that can be pushed under the top plate. A guide stirrup carrying an adjusting screw for a leaf spring secured at one end on the slide and at the other end above the top plate is secured on the slide. A wedge piece is secured on the top plate below the moving range of the leaf spring and it has a wedge surface which is inclined in an opposite direction to the wedge surface of the slide. In this embodiment, the slide provided with a wedge surface forms an adjusting element which can be inserted directly between the two plates. The clamping element is formed by the wedge piece which is secured on the top plate, and which is not coupled, however, directly but indirectly with the adjusting element since the leaf spring slides up and down on the wedge surface of the wedge piece when the slide is displaced and produces a selected pressure at the pressure point.

Accordingly, it is an object of the invention to provide a guiding device for sewing machines having means for feeding cloth workpieces into association with a moving needle in a stitch forming area for effecting edge parallel seams which comprises a bottom plate which has at least a portion supported above a table and defines a workpiece layer feeding space therebetween and which includes a top plate overlying said bottom plate and having the portion spaced above the plate and defining a workpiece layer passageway therebetween which includes a pressure point at a spaced location from the stitch forming area and means defining a ruler extending laterally at an acute angle to align extending in the workpiece feed direction and which further includes spring means bearing down on the top plate and adjustment means associated with the spring for varying the effect of biasing force and the spacing between the plates.

A further object of the invention is to provide a guiding device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

GENERAL DESCRIPTION OF THE PREFERRED EMBODIMENTS

Figure 1:
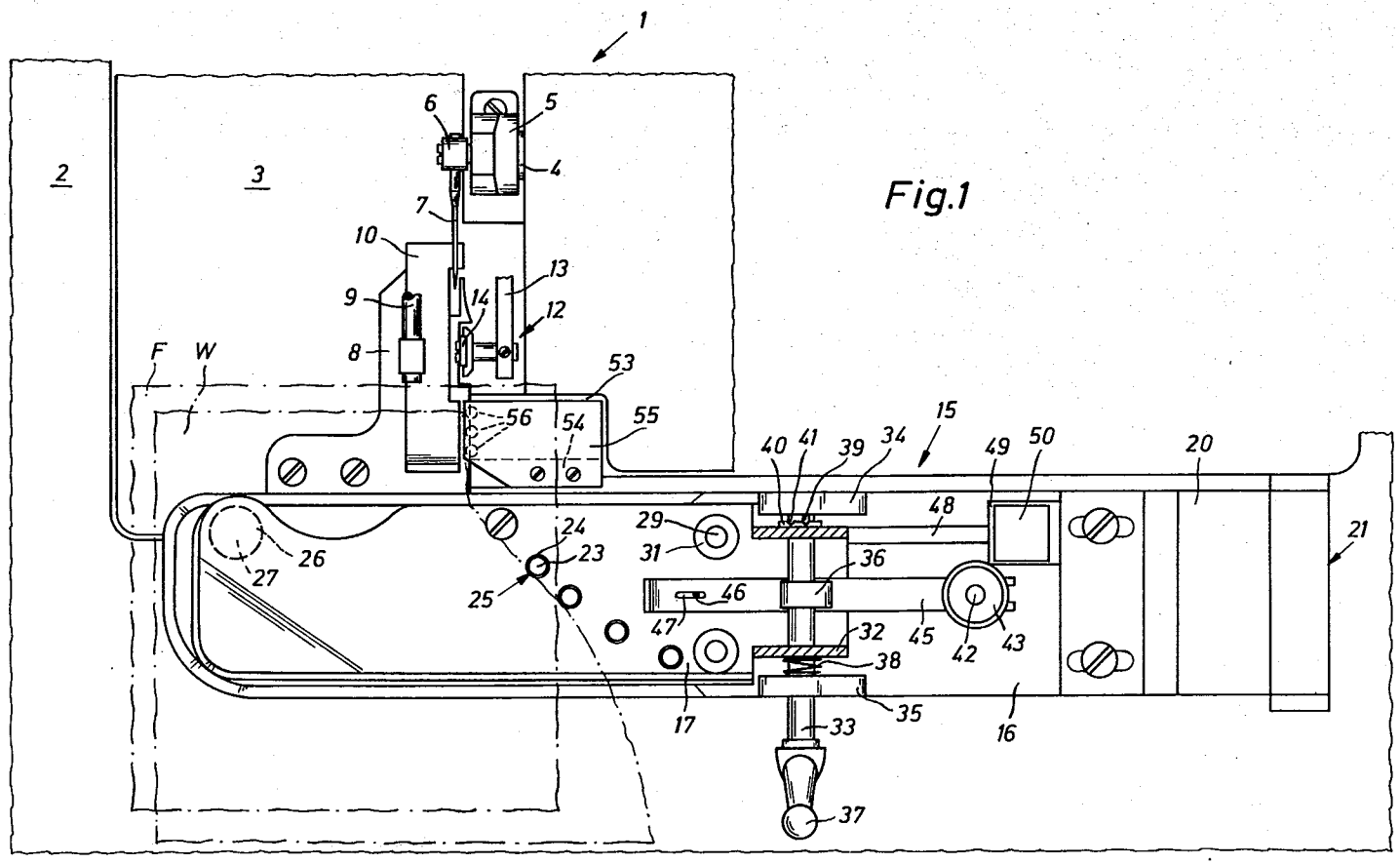
FIG. 1 is a top plan view of a guiding device for a sewing machine constructed in accordance with the invention.
Figure 2:
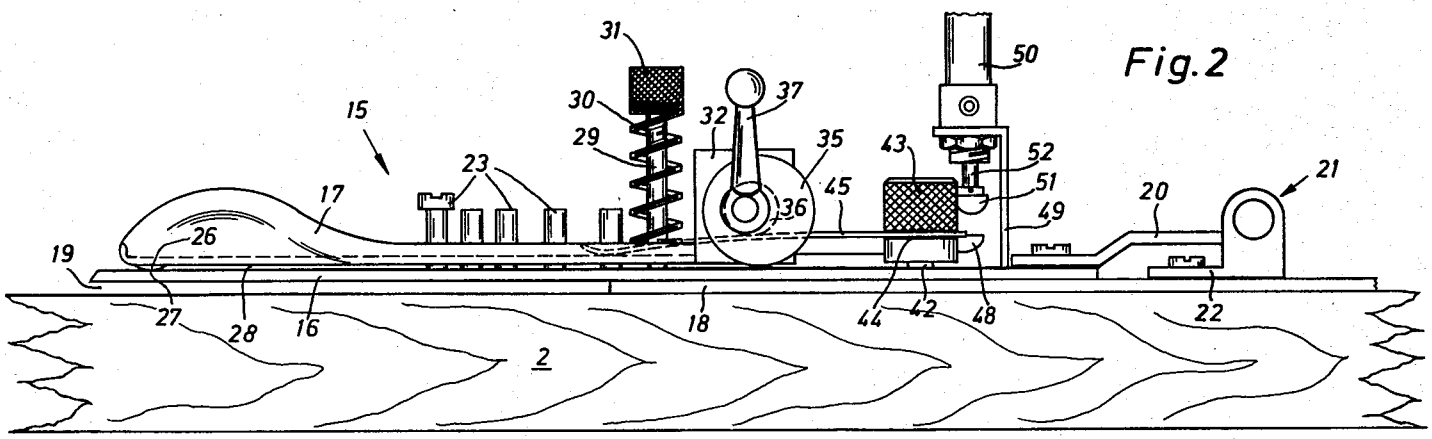
FIG. 2 is a side elevation of the device shown in FIG. 1.
Figure 3:
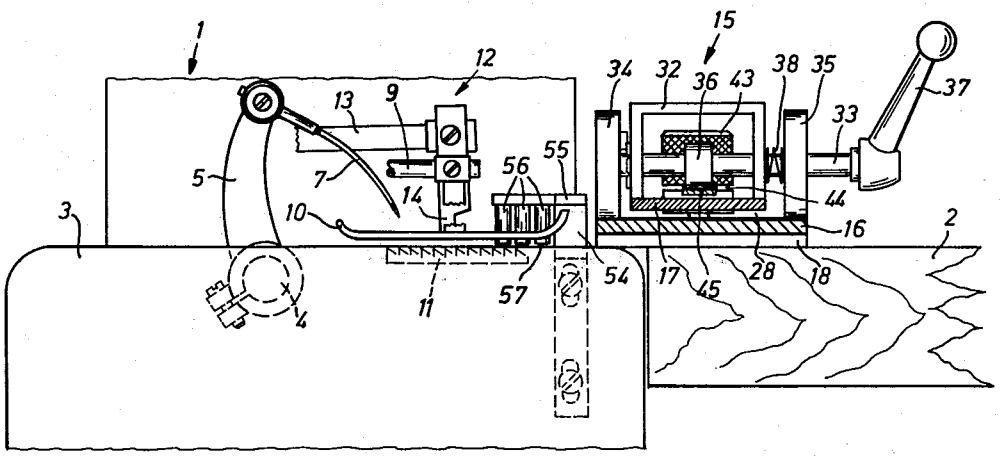
FIG. 3 is a partial transverse sectional view of the guiding device shown in FIG. 1.

Referring to the drawings, in particular, the invention embodied therein in FIGS. 1, 2, and 3 comprises the support table or plate 2 which is fitted around a base 3 of a sewing machine. The sewing machine includes a swing shaft 4 which carries an arm 5 having a needle holder 6 containing a curved needle 7. The sewing machine 1 also includes a bar 9 carrying a presser foot 10. Workpieces fed during sewing by a bottom feed 11 which engages the workpiece through recesses (not shown) in a stitch plate of the base 3. The trimmer for the workpiece is designated 12 and it includes a swing lever 13 with a blade 14. A stitch blade 8 provides a counter blade which is designed as a cutting edge.

In accordance with the invention, a guiding device 15 shown in FIGS. 1 to 3 comprises a bottom plate 16 which includes at least a portion arranged in spaced vertical relationship to a top plate 17. The bottom plate 16 bears on a distance plate or spacer 18 which rests on the table plate 2. The spacer 18 is only half as long as the bottom plate 16 so that the left portion of the bottom plate 16, as shown in FIG. 2, is arranged at a spaced distance above the table plate 2 and a passageway 19 for one layer of a workpiece material is formed between the plate 2 and the plate 16.

An offset plate 20 is mounted on a hinge 21 and one end of the bottom plate 16. The offset plate is hinged to a second hinge plate part 22 which is secured on the table 2. The offset plate 20 also bears on the spacer plate 18 and is secured to the plate on the table 2. The ruler or workpiece guide means comprises a plurality of substantially vertical cylindrical pins 23 which are mounted on the bottom plate 16 and which protrude through openings 24 of the top plate 17. The pins 23 form a slightly curved ruler 25 for a workpiece between the two plates 16 and 17 along which the edge of the workpiece bears during the sewing operation. The pins are arranged along a line which extends laterally in an acute angle to a line extending in the direction of feed of the workpiece through the needle axis. The angle in the inventive device is somewhat greater than in the known devices. The flat arcuate pressure piece 26 made of plastic material is arranged on the underside of the top plate 17 on the side of the line which extends in the feed direction through the needle axis opposite to the pins 23 and which forms a pressure point 27 for the workpiece. At the front side in the direction of feed of the workpiece, the top plate 17 is bent obliquely upwardly to facilitate the entrance of the workpiece into the passageway 28 arranged between the two plates 16 and 17.

The plate 17 is urged toward the bottom plate 16 by compression springs 30, 30 which are arranged around threaded bolts 29, 29 which are located to the right of the cylindrical pins 23 as shown in FIG. 2. The compression force on the springs is adjusted by an adjusting nut 31. Further biasing adjustment means comprises a U-shaped stirrup 32 which is secured on top plate 17 at the narrower end thereof opposite the pressure point 27. The shaft 33 is rotatably mounted in the stirrup 32 and it carries two outer eccentrics 34 and 35 of equal size and a central smaller eccentric 36 which is arranged between the outer two inside the stirrup 32. The shaft 33 may be rotated by a handle 37. The three eccentrics 34, 35, and 36 are arranged in the same phase position. The outer two eccentrics 34 and 35 form an adjusting element for the top plate 17 so as to regulate the spacing between the two plates 16 and 17 and to also regulate the clamping tension on the plates. The shaft 33 in the associated eccentrics are held in the respective adjusted position by detent means including cam 39 arranged on the lateral surface of the eccentric 34 facing the stirrup 32. Stirrup 32 carries a disc 40 which has several radially extending notches 41 distributed in a circle. The compression spring 38 disposed between the cam 35 and the opposite leg of the stirrup 32 effects a forced locking engagement of the cam 39 in one of the notches 41 to set the eccentrics in an adjusted position.

Spring means in the form of a leaf spring 45 in addition to the spring 30 forms a biasing force on the top plate 17. One end of the spring 45 is bifurcated to form leg portions which fit into respective sides of a radial annular groove 44 of an adjusting nut 43 which is carried on a threaded bolt 42 secured to the bottom plate 16. The leaf spring extends under the eccentric 36 and has an opposite end which is bent upwardly on top plate 17. Leaf spring 45 is pressed downwardly by the adjusting nut 43 on one side of the eccentric 36 and the opposite end of the spring bears on the plate 17. Since the effective thickness of the eccentric 36 for the leaf spring 45 varies during the rotation of the shaft 33, the leaf spring 45 will be regulated in respect to tension force and dependence upon the direction of the rotation so that the eccentric 36 performs the function of a tensioning element. In this embodiment, the adjusting element formed by the eccentrics 34 and 35 and the tensioning element formed by the eccentric 36 are directly coupled with each other since the eccentrics 34, 35, and 36 are secured on a common shaft 33. The lateral guidance of the leaf spring 45 is effected by a pin 46 secured in the top plate 17 and which protrudes into an oblong slot 47 provided in the leaf spring 45.

The stirrup 32 also carries an arm 48 which extends at a spaced location above the bottom plate 16. A pneumatic cylinder 50 is arranged on an angle plate 49 which is secured on a bottom plate 16 and it carries a piston rod 42 which has a pressure piece 51 which is arranged above the arm 48. The plate 55 is arranged in a trough of the stitch plate 8 and an angle plate 54 is secured thereto offset under the stitch plate 8. Three vertical downwardly protruding pins 56 and the plate 55 terminate a small distance above the stitch plate 8 and thus form a flat passage 57.

Figure 4:
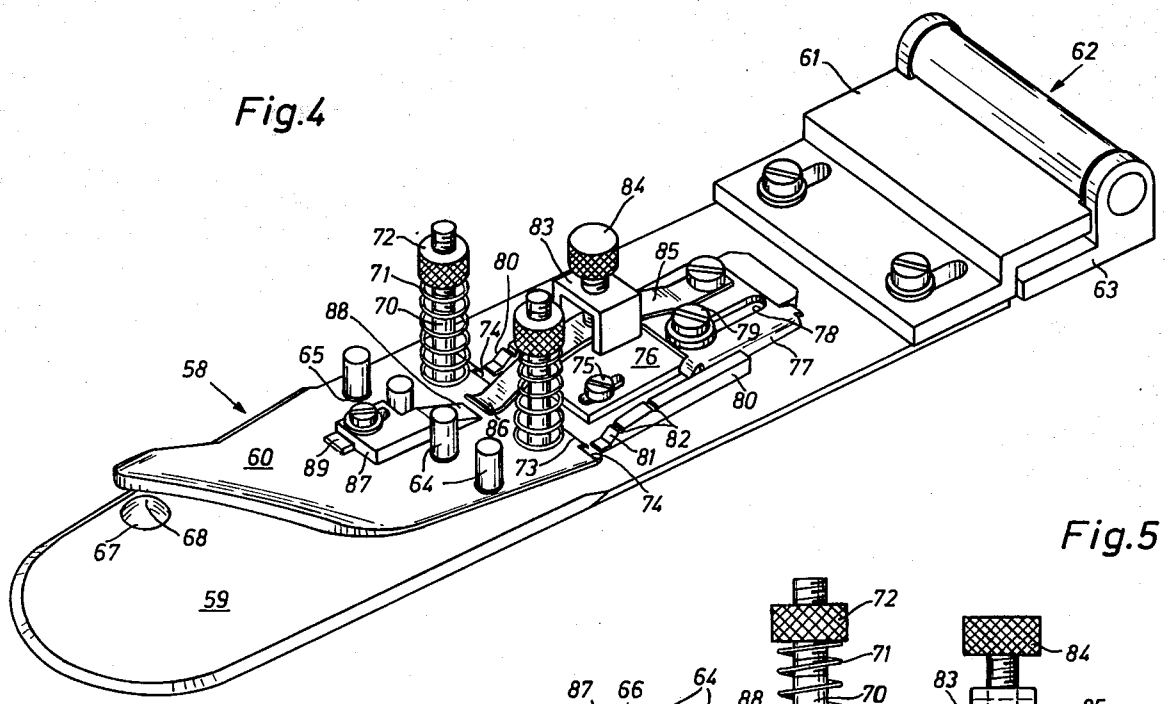
FIG. 4 is a front top perspective view of another embodiment of the guiding device.
Figure 5:
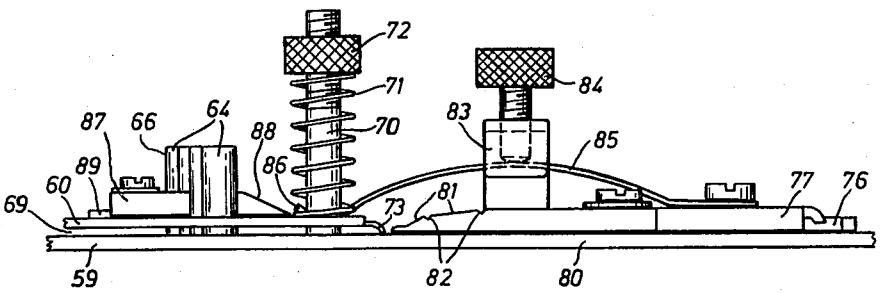
FIG. 5 is an enlarged partial side elevational view of the device shown in FIG. 4.

In the embodiment of the invention shown in FIGS. 4 and 5, there is a guiding device generally designated 58 which includes a bottom plate 59 and a top plate 60. At the right end of the bottom plate 59 is secured an offset hinge plate 61 of a hinge 62 which includes another hinge plate 63 which is secured on a spacer plate (not shown) or directly on the table plate 2. Several upright cylindrical pins 64 are secured in the bottom plate 59 and they protrude through opening 65 of the top plate 60. The pins 64 form a ruler 66 for a workpiece between the two plates 59 and 60 on which the heads of the workpiece bears during the sewing operation. The pins 64 are arranged in a line similar to the pins 23 of the first embodiment and they extend laterally in an acute angle to a line extending in the direction of the feed of the workpiece through the needle axis.

The top plate 60 is shown in FIG. 4 in a raised position. Pressure piece 67 is secured on the top side of the bottom plate 59, has a flat curve shape similar to a calotte and similar to the pressure plate 26 of the first embodiment and it is made of a plastic material. The pressure piece 67 forms a pressure point 68 for the workpiece. The top plate 60 is bent obliquely upwardly on the front side in the direction of feed of the workpiece so that the entrance of the workpiece into the passageway 69 between two plates 59 and 60 is facilitated as shown in FIG. 5. The bottom plate 59 carries two threaded bolts 70 which protrude through corresponding openings (not shown) of the top plate 60 and which carry each a compression spring 71 and an adjusting nut 72.

As shown particularly in FIG. 5, the right edge 73 of the top plate 60 is bent downwardly by about 1 – 2 mm so that the part of the plane underside of top plate 60 close to the edge 73 cannot bear on the bottom plate 59, but has a spacing of about 1 – 2 mm above the plate 59. Two recesses 74 are provided in the edge 73. At a small distance from the edge 73 is secured the guide plate 76 by screws 75 which engage in the bottom plates 59. The guide plate 76 carries a slide 77 which embraces the guide plate in a U-configuration and moves in a longitudinal direction and it carries an oblong slot 78. A screw 79 extends through the slot 78 and limits the displacement path and prevents the slide 77 from being lifted from the guide plate 76. Arm 80 is secured to each side of the slide 78 and extends up to the top plate 60 when the slide 77 is retracted to the position shown in FIG. 4. The arms 80 carry wedge surfaces 81 and transversely extending notches 82. The slide 77 forms with its arms 80 an adjusting element for the top plate 60 which can be shifted so as to vary the distance between it and the plate 59. The U-shaped stirrup 83 is secured on the rear arm 80 and it carries a central portion into which is threaded an adjusting screw 84. Stirrup 83 serves as a lateral guide for a curved leaf spring 85 which is secured by a bolt at its one end on a slide 77 and at the other end bears directly on the top plate 60 even with the slide 77 retracted. An adjustable wedge piece 87 having wedge surfaces 88 is arranged in the moving range of the front upbent end 86 of the leaf spring 85 on the top plate 60. Wedge piece 87 may be shifted longitudinally and it is guided laterally by a guide plate 89 secured on the top plate 60. Depending on the position of the slide 77, the end 86 of the leaf spring 85 engages on the lower or the upper part of the wedge surface 88 and presses the wedge piece 87 with a correspondingly less or greater force which is transmitted to the plate 60. The wedge piece 87 thus performs a function similar to that of a clamping element. In this second embodiment, this clamping element is only indirectly coupled with the adjusting element formed by the slide 77 since it does not participate in the adjusting movement of the slide 77 but serves as a fixed abutment for a leaf spring 85 moving together with the slide 77.

The method of operation of the first embodiment shown in FIGS. 1 and 2 and 3 is as follows: when sewing or trimming trousers with knee linings, it was found expedient for economical and manufacturing reasons to use the same cuts F for different trouser sizes. The marginal strip of cut F projecting more or less over the trouser part, depending upon the respective size, is cut off during the sewing by the trimming device 12. Due to this technique, cut F need not be constantly aligned with its contour during the sewing. Cut F is therefore inserted not into guiding device 15 but into the free passageway 19 below bottom plate 16, as well as into the passageway 57 between the stitch plate 8 and the pins 56.

Before inserting the trouser part designated as a workpiece W, piston rod 52 of the pneumatic cylinder 50 is extended so that the pressure piece 51 is pressed on the arm 48 and the top plate 17 swings upwardly. This swinging movement takes place about an axis which coincides with the contact lines between the eccentrics 34 and 35 and the bottom plate 16. Workpiece W is now inserted in the enlarged passageway 28 and is aligned with its front end at the pins 56. Then piston rod 52 is retracted so that the compression springs 30 and the leaf springs 45 press the top plate downwardly. Workpiece W can now be pulled between the plates 16 and 17 but the pressure piece 26 exerts a braking effect on the workpiece W.

During the sewing, cloth feed 11 exerts on the workpiece W a traction in a feeding direction and imparts to it the usual feeding motion. Due to the traction exerted on the workpiece W and the braking effect of the pressure piece 26, the workpiece performs in a known manner a rotary movement about a vertical axis. Due to this rotary movement, the edge of the workpiece W is turned toward the ruler 25 formed by the pins 23 and then moved along the ruler and the pins 56. In this way, the workpiece W fed to the stitch forming area is aligned with its contours. The lining cut F, on the other hand, which is separated from the workpiece W by the bottom plate 16 moves straight to the stitch forming area.

The pressure at the pressure point 27 required for the production of the braking action is produced in this embodiment partly by the compression springs 30 and partly by the leaf springs 45. The compression springs 30 serve to exert on top plate 17 a steady and uniform initial pressure which remains unchanged with different workpieces W. Leaf spring 45 produces an additional force, which is adapted to the requirement determined by the thickness and surface quality of the workpiece W. With thin workpieces W, the smallest effective thickness and the smallest eccentricity of the eccentrics 34 and 35 is set by rotating shaft 33 so that the top plate 17 has only a small spacing from the bottom plate 16. This has the advantage that the thin and therefore particularly flexible workpiece W has no opportunity to bend or coil at the pins 23 on which it is pressed by the aligning action of the guiding device 15. Since all of the three eccentrics 34, 35, and 36 are arranged in the same phase position, eccentric 36 is pressed in this position of shaft 33 with the smallest eccentricity on leaf spring 45 so that the leaf spring 45 only exerts a low additional force on the top plate 17. This results at pressure point 27 in a relatively low total force, the size of which is adapted to the processing requirements for thin workpieces. By turning adjusting nut 43, it is possible to obtain a further variation of the additional force produced by leaf spring 45, which is independent of the position of eccentric 36. This way it is possible, for example, to set the higher pressures required for workpieces with a smooth surface.

In workpieces W with a medium cloth thickness, the eccentrics 34, 35, 36 are turned by means of handle 37 into the position represented in the drawings. The mean eccentricity of eccentrics 34, 35 becomes effective relative to bottom plate 16 so that the shaft 33 and thus stirrup 32 and top plate 17 are lifted. At the same time eccentric 36 acts with its medium eccentricity on leaf spring 45, so that the additional force exerted by it at pressure point 27 increases, as required, more with thin workpieces. The above-described process is repeated when guiding device 15 is set for thick workpieces. In this case the greatest eccentricity of the eccentrics 34, 35, 36 is achieved by turning handle 37 further, and top plate 17 is thus lifted to the maximum possible height. At the same time leaf spring 45 is further tensioned and the pressure at pressure point 27 increased as required. Due to the lifting of the right end of plate 17 with regard to FIG. 2, the latter maintains its parallel position to bottom plate 16 when workpieces W with medium or great cloth thickness are processed. Passageway 28 for workpiece W, which will have the same height over the entire width, is an important prerequisite for a satisfactory alignment. If the right end of top plate 17 were not lifted sufficiently, the inclined top plate 17 would press on workpiece W in the range of the pins 23 and produce friction at this point, which hinders the alignment starting from pressure point 27.

The second embodiment represented in FIG. 4 and 5 works exactly like the first embodiment, as far as the alignment of the contours of workpiece W is concerned, so that a description is not necessary. Here, too, the pressure at the pressure point necessary for the braking action is produced partly by the compression springs 71 and partly by leaf spring 85. The compression springs 71 serve to exert a constant initial stress on top plate 60, while leaf spring 85 produces an additional force adapted to the requirements of the workpiece.

During the sewing of thin workpieces, slide 77 is in the retracted position shown in the drawing in which the free end of the arms 80 and their wedge surfaces 81 respectively are spaced from edge 73 of top plate 60 and in which the upbent end 86 of leaf spring 85 bears directly on top plate 60 in front of wedge piece 87. In this position of slide 77 the down-bent edge 73 of top plate 60 bears directly on bottom plate 59, so that the height of passageway 69 in the range opposite the pressure point 68 is determined by the height of the bent edge 73. Leaf spring 85 produces only a low additional force, so that a relatively low total pressure acts at pressure point 68, as it is required for thin workpieces. The additional force can be varied by turning adjusting screw 84, while slide 77 remains in its position.

For workpieces of medium cloth thickness, slide 77 is displaced in the direction of top plate 60, so that the front wedge surfaces 81 move under top plate 60 and lift the end opposite pressure point 68. This position of slide 77 is locked by the boundary edges of recesses 74 parallel to edge 73 engaging the front notches 82. Together with the arms 80 leaf spring 85 has also been advanced, so that its end 86 now bears on the lower part of wedge surface 88 of wedge piece 87, thus producing a greater additional force. For thick workpieces, slide 77 is advanced further, until the boundary edges of recesses 74 engage the rear notches 82. The rear wedge surfaces 81 have moved under top plate 60 and lifts its end opposite pressure point 68. Likewise leaf spring 85 has been further advanced, so that its end 86 now bears on the upper part of wedge surface 88 and thus produces a greater additional force.

While specific embodiments of the invention have been shown and described in detail to illustrate the application of the principles of the invention, it will be understood that the invention may be embodied otherwise without departing from such principles.

What is claimed is:

1. A guiding device for sewing machines having means for feeding cloth workpieces into association with a moving needle in a stitch forming area for effecting edge parallel seams, comprising a support table, a bottom plate supported on said support table, a top plate overlying said bottom plate and defining a workpiece layer passageway therebetween and having a pressure point at a spaced location from the stitch forming area, means defining a ruler between said top and bottom plates in said workpiece layer passageway and extending laterally at an acute angle to a line extending in the workpiece feed direction, spring means bearing downwardly on said top plate, and adjustment means carried on said table and operatively associated with said spring means and said top plate to vary both the effect of biasing force thereof and the spacing between said top and bottom plates.

2. A guiding device for sewing machines having means for feeding cloth workpieces into association with a moving needle in a stitch forming area for effecting edge parallel seams, comprising a support table, a bottom plate supported on said support table, a top plate overlying said bottom plate and defining a workpiece layer passageway therebetween and having a pressure point at a spaced location from the stitch forming area, means defining a ruler between said top and bottom plates in said workpiece layer passageway and extending laterally at an acute angle to a line extending in the workpiece feed direction, spring means bearing downwardly on said top plate, adjustment means carried on said table and operatively assciated with said spring means to vary the effect of biasing force thereof and the spacing between said top and bottom plates, wherein said spring means comprises a leaf spring having one end bearing on said top plate and an opposite end, means supporting said opposite end above said bottom plate, said adjustment means comprising an eccentric engageable with said spring intermediate its length to vary the force acting on said spring.

3. A guiding device according to claim 2, wherein said spring means comprises a leaf spring having one end overlying said top plate, means for supporting the opposite end above said bottom plate, a stirrup carried by said top plate, a shaft journalled in said stirrup for rotation thereon, said shaft having an eccentric at each end adapted to bear against said bottom plate and a central eccentric adapted to bear on said spring, said shaft being rotatable to increase the eccentricity and to increase the bearing pressure on said spring and comprising said adjustment means.

4. A guiding device according to claim 3 including a bolt secured to said bottom plate and extending through said top plate, and having a nut at the outer end thereof, a compression spring disposed between said nut and said top plate and comprising said spring means with said leaf spring, said nut being displaceable relative to said spring for varying the compression force thereof.

5. A guiding device according to claim 4 including an arm connected to said stirrup, a fluid cylinder mounted on said bottom plate, a piston movable in said cylinder and having a piston rod with a pressure piece engageable with said arm to press said arm downwardly to move said stirrup and said top plate.

6. A guiding device according to claim 4, wherein means supporting said opposite end of said leaf spring includes a bolt threaded into said bottom plate and engaged with said leaf spring.

7. A guiding device according to claim 2, wherein said spring means and said adjustment means comprise a slide mounted on said bottom plate for longitudinal movement therealong, a leaf spring carried by said slide and having an end extending outwardly from said slide and bearing on said top plate, and a stirrup overlying said leaf spring intermediate its length and an adjusting screw threaded into said stirrup and engageable with said spring for varying the tension thereof.

8. A guiding device according to claim 7, including an arm carried by said slide and having a wedging surface engageable beneath said top plate to raise said top plate when said slide is advanced toward said top plate.

9. A guiding device according to claim 8, wherein said top plate has an end adjacent said slide which is bent downwardly and which supports said top plate at a spaced distance above said bottom plate, said downturned end having an opened portion, said arm of said slide being enterable into the open portion to lift this end of said top plate.

10. A guiding device according to claim 9, including a bolt member connected to said bottom plate and extending upwardly through said top plate, a nut threaded onto said bolt member, and a compression spring disposed between said nut and said top plate.

11. A guiding device for sewing machines having means for feeding cloth workpieces into association with a moving needle in a stitch forming area in order to form edge parallel seams on the workpiece, comprising a support table, a bottom plate mounted on said support table, a top plate overlying said bottom plate and having at least a portion spaced above said bottom plate and defining a workpiece layer passageway between said top and bottom plates and having a pressure point at a spaced location from the stitch forming area, a spring secured to said table and having a contact portion bearing downwardly on said top plate, and an adjustable clamping member mounted on said table and engageable with said spring and said top plate simultaneously to vary the biasing force of said spring and the spacing between said top and bottom plates.

12. A guiding device for sewing machines having means for feeding cloth workpieces into association with a moving needle in a stitch forming area in order to form edge parallel seams on the workpiece, comprising a support table, a bottom plate mounted on said support table, a top plate overlying said bottom plate and having at least a portion spaced above said bottom plate and defining a workpiece layer passageway between said top and bottom plates and having a pressure point at a spaced location from the stitch forming area, a spring secured to said table and having a contact portion bearing downwardly on said top plate, and an adjustable clamping member mounted on said table and engageable with said spring and said top plate simultaneously to vary the biasing force of said spring and the spacing between said top and bottom plates, including a wedge member movable mounted on said top plate and having a wedging surface tapering downwardly toward said top plate, a leaf spring having an end bearing downwardly on said top plate, and means mounting said spring on said support table over said top plate.

13. A guiding device according to claim 12, wherein said adjustable clamping member comprises a rotatable cam mounted over said spring intermediate its length and being rotatable to prevent a surface increasing engagement with said spring to vary the downward biasing force thereof.

* * * * *